US010214006B2

(12) United States Patent
Von Heesen et al.

(10) Patent No.: US 10,214,006 B2
(45) Date of Patent: Feb. 26, 2019

(54) METHOD AND DEVICE FOR APPLYING ADHESIVE TAPE TO CYLINDRICAL BODIES

(71) Applicant: Lohmann GmbH & Co. KG, Neuwied (DE)

(72) Inventors: Florian Von Heesen, Neuwied (DE); Tobias Spiess, Neuwied (DE); Gerd Rottmann, Neuwied (DE); Peter Harendt, Neuwied (DE)

(73) Assignee: LOHMANN GMBH & CO. KG, Neuwied (DE)

( * ) Notice: Subject to any disclaimer, the term of this patent is extended or adjusted under 35 U.S.C. 154(b) by 297 days.

(21) Appl. No.: 14/905,161

(22) PCT Filed: Jul. 14, 2014

(86) PCT No.: PCT/EP2014/065048
§ 371 (c)(1),
(2) Date: Jan. 14, 2016

(87) PCT Pub. No.: WO2015/007688
PCT Pub. Date: Jan. 22, 2015

(65) Prior Publication Data

US 2016/0159079 A1 Jun. 9, 2016

(30) Foreign Application Priority Data

Jul. 15, 2013 (DE) ..... 10 2013 107 470

(51) Int. Cl.
*B41F 27/00* (2006.01)
*B41F 27/12* (2006.01)
(Continued)

(52) U.S. Cl.
CPC ..... *B41F 27/1275* (2013.01); *B41F 27/005* (2013.01); *B41N 6/02* (2013.01);
(Continued)

(58) Field of Classification Search
CPC ..... B41F 27/005; B41F 27/1275; B41P 2200/12; Y10T 156/1033; B65C 9/1819; Y10S 101/36
(Continued)

(56) References Cited

U.S. PATENT DOCUMENTS 3,834,963 A * 9/1974 Hoffman ..... B65C 3/12 156/215
5,904,804 A 5/1999 Kouda et al.
6,533,015 B1 3/2003 Moore

FOREIGN PATENT DOCUMENTS

CA 2151969 A1 11/1996
DE 2416472 C3 10/1974
(Continued)

OTHER PUBLICATIONS

International Search Report for PCT/EP2014/065048, dated Nov. 19, 2014 (original in German and English translation) (4 pages).

*Primary Examiner* — Carson Gross
(74) *Attorney, Agent, or Firm* — Bookoff McAndrews, PLLC

(57) ABSTRACT

The invention relates to a device for applying adhesive tape (40) to the cylindrical surface (21) of a cylindrical body (20), said device comprising: at least two axially parallel securing rolls (30*a*, 30*b*) designed to make contact with the cylindrical surface of the cylindrical body; an adhesive tape feed for feeding the adhesive tape (40) to the cylindrical body (20); and means for rotating the cylindrical body (20) about its cylindrical axis.

11 Claims, 7 Drawing Sheets

(51) Int. Cl.
*B41N 6/02* (2006.01)
*B65C 9/18* (2006.01)

(52) U.S. Cl.
CPC ..... *B41P 2200/12* (2013.01); *B65C 9/1819* (2013.01); *Y10S 101/36* (2013.01); *Y10T 156/1033* (2015.01)

(58) Field of Classification Search
USPC ..... 156/187, 446, 447, 458
See application file for complete search history.

(56) References Cited

FOREIGN PATENT DOCUMENTS

| | | | | | |
|---|---|---|---|---|---|
| DE | 3545425 | A1 | | 7/1986 | |
| DE | 4200634 | A1 | | 7/1993 | |
| DE | 199 29 630 | A1 | | 1/2001 | |
| DE | 202006006452 | U1 | | 7/2006 | |
| EP | 2 535 187 | A1 | | 12/2012 | |
| FR | 956044 | A | | 11/1947 | |
| FR | 956044 | A | * | 1/1950 | ..... B65C 3/12 |
| FR | 2602209 | A1 | | 2/1988 | |
| GB | 811924 | A | | 4/1959 | |
| GB | 1470287 | A | | 4/1977 | |

* cited by examiner

METHOD AND DEVICE FOR APPLYING ADHESIVE TAPE TO CYLINDRICAL BODIES

This application is a U.S. national stage filing under 35 U.S.C. § 371 of International Application No. PCT/EP2014/065048, filed on Jul. 14, 2014, which claims the benefit of priority to German Patent Application No. 102013107470.7, filed on Jul. 15, 2013, each of which is incorporated by reference herein.

The invention relates to a device for fitting adhesive tape to cylindrical bodies like, for example, cylindrical flexographic printing formes.

In the case of a cylindrical flexographic printing forme the printing cylinder of the printing press is provided with a printing layer or a print relief over the entire circumference. In principle, the actual printing cylinder of the printing press can itself be provided with a completely enveloping printing layer. However, this procedure has the disadvantage that in certain circumstances the entire printing cylinder has to be replaced when the printing forme is changed and this can be complicated. The use of "sleeves" is therefore usual. A sleeve is a cylindrical hollow body, which has been provided with a printing layer or a print relief on its outer cylindrical surface. The sleeve technique permits very rapid and simple changing of the printing forme. The internal diameter of the sleeves corresponds to the external diameter of the printing cylinder, so the sleeves can be simply pushed over the printing cylinder of the printing press. Further details of the sleeve technique are disclosed, for example, in "Technik des Flexodrucks", p. 73 ff., Coating Verlag, St. Gallen, 1999.

Usually a cylindrical flexographic printing forme is produced by sticking a flexo printing plate, carrying the printing layer or the print relief on its outward-facing side, onto the outside cylindrical surface of the printing cylinder or sleeve. This is customarily done using a double-sided adhesive tape, one adhesive surface of which is first stuck to the external cylindrical surface of the printing cylinder or sleeve. The flexo printing plate is then stuck onto the rear adhesive surface of the double-sided adhesive tape, specifically in such a way that the printing layer or the print relief faces outwards and now forms the surface of the cylindrical flexographic printing forme.

In this connection the double-sided adhesive tape usually has pressure-elastic properties, in order to reduce or prevent "dot gain", an undesirable effect in flexo printing. Dot gain results from the fact that the printing surfaces of the printing layer or the print relief are raised in flexo printing. That means, there are generally frustoconical dots present, which spread elastically as a result of the forces arising during the printing process. This leads directly to a spreading of the printed dot, i.e. to dot gain. To prevent this undesirable effect, the printing plates are not fastened directly to the printing cylinder or the sleeve, but an elastic and compressible intermediate layer is provided for, which deforms elastically in the printing process and thus reduces the dot gain, which can lead to losses in printing quality. Usually the double-sided adhesive tape takes on the function of the elastic and compressible intermediate layer by having a certain material thickness and pressure-elastic properties. Accordingly, suitable adhesive tapes usually have a foam core.

Thus, the resulting requirements for the process of applying the adhesive tape to the printing cylinder or sleeve are high. First it must be ensured that the adhesive action between the inward-facing adhesive surface of the adhesive tape and the surface of the printing cylinder or sleeve is even and of sufficient intensity. The pressure when the adhesive tape is applied to the printing cylinder or the sleeve must therefore be uniform and well measured over the entire surface. At the same time the pressure must not be too strong, especially not too strong at isolated points; otherwise, the foam core of the adhesive tape, especially in some areas, could collapse. As a result the pressure-elastic properties of the adhesive tape, especially in some areas, would thus be impaired, which again would lead to the undesirable dot gain.

In addition, uniform application of the adhesive tape is made more difficult by the fact that the printing cylinder or sleeve is normally heavy and has a large surface area and is therefore not easy to handle. With regard to the sleeve there is the added factor that this is an axleless structure, so holding and guiding it is again complicated.

Furthermore, because of the material thickness of the adhesive tape, it must be ensured, when the printing cylinder or the sleeve is enveloped, that neither a large gap remains on the abutting edges of the adhesive tape, nor that the adhesive tape overlaps at the abutting edges and thus forms a prominent bulge on the cylinder surface.

For the aforementioned reasons the adhesive tape is normally applied by hand or with a considerable proportion of manual work, a procedure which is firstly time-consuming and therefore expensive and secondly susceptible to errors.

The object of the invention is accordingly to provide a device and a method for fitting adhesive tape to cylindrical bodies like, for example, cylindrical flexographic printing formes, where fitting is done largely automatically, in order largely to prevent or to reduce the aforementioned disadvantages of the prior art, and where the requirements described are met as far as possible.

The object is achieved with the device and the method of the independent claims, whereby preferred embodiments are set out in the dependent claims.

In accordance with the invention it is possible to apply an adhesive tape largely or completely automatically to cylinders or cylindrical bodies of various diameters.

A "cylinder" within the meaning of the invention is a body which is limited by two parallel circular surfaces (bottom surface and top surface) and a lateral surface or cylindrical surface, which is formed from parallel straight lines.

A "cylindrical body" within the meaning of the invention is a body, the structure of which largely corresponds to the shape of a cylinder, but which could have especially the bottom surface and the top surface missing. To that extent the term "cylindrical body" comprises not only cylinders in the above sense, but also sleeves and hollow cylinders.

"Adhesive tape" within the meaning of the invention is a collective term for carriers coated on one or two sides with adhesives. Adhesive tapes are known in a large plurality of forms and available on the market. Typical carrier materials are polymer films like, for example, polypropylene, polyethylene, polyethylene terephthalate, polyvinyl chloride or acetate film, paper, metal foils, fabric carriers such as textile fabrics and foam carrier materials. Preferred carrier materials in connection with the production of cylindrical flexographic printing formes are foam carrier materials, made, for example, from closed-cell foam of polyethylene or an ethylene-vinyl acetate copolymer, optionally coated on one or two sides with an unfoamed polyethylene film, which give the adhesive tape pressure-elastic or compressible properties. The carrier can be coated with adhesive on one or two sides. The adhesives for the production of adhesive tapes can be selected from a large plurality of commonly used materials. These could be, for example, SIS rubbers, SBS rubbers, polyisobutylenes, polyisoprenes, polyacrylates and natural rubbers, perhaps with the addition of tackifying natural and/or synthetic resins.

The device for applying adhesive tape to a cylindrical surface of a cylindrical body comprises essentially two axially parallel securing rolls, which are designed to make contact with the cylindrical surface of the cylindrical body; an adhesive tape feed for feeding adhesive tape to the cylindrical body; and means for setting the cylindrical body into rotation about its cylindrical axis.

The securing rolls are preferably consistently uniform rolls with a circular cross-section, which extend in the direction of their roll axis at least over the entire length of the cylindrical body to which adhesive tape is to be applied. The securing rolls are rotatably mounted, e.g. by means of rotatable mounting of their axes. The securing rolls are preferably axially parallel on the horizontal plane and, at least during the time of application of adhesive tape to the cylindrical body, are disposed with a gap between them that is smaller than the cylinder diameter of the cylindrical body to which adhesive tape it is to be stuck. Two or more securing rolls can thus form a roll bed, in which the cylindrical body to which adhesive tape it is to be stuck can lie and be held by its own weight.

Preferably at least one of the securing rolls is mounted so it can be repositioned in one or more directions orthogonally to its roll axis. This allows the gap between the securing rolls to be varied, e.g. in order to adapt the relative position of the securing rolls to each other to the particular cylinder diameter of the cylindrical body to which adhesive tape it is to be stuck. Furthermore, through repositioning of the securing rolls in relation to each other, the cylindrical body to which adhesive tape it is to be stuck can be either held or released. In this way it is also possible, especially, to generate a pressure of the securing rolls on the cylindrical body and, if need be, to adjust it.

At least during the application of adhesive tape to the cylindrical body the securing rolls apply a pressure onto the cylindrical body. One way of achieving this is by means of the cylindrical body's own weight, with the cylindrical body lying on at least two securing rolls. Preferably, however, the pressure is produced and controlled through the use of at least three securing rolls, which are disposed around the cylindrical circumference of the cylindrical body and pinch it against each other. Preferably, therefore, in profile, the axis positions of the three or more securing rolls form a triangle or polygon, within the triangular area or polygonal area of which the axis position of the cylindrical body is located. The cylindrical body can thus be pinched effectively between the three or more securing rolls, whereby a movement of the rolls towards each other increases the pressure on the cylindrical body.

As a result of the pressure that the securing rolls exert on the cylindrical body it is possible, owing to friction that exists between the surfaces of the securing rolls and of the cylindrical body, to set the cylindrical body into rotation about its cylindrical axis by rotating one or more of the securing rolls. For this it is advantageous to equip at least one of the securing rolls with a drive.

At the same time the pressure that the securing rolls exert on the cylindrical body performs the important task of bringing the adhesive surface of the adhesive tape that is being applied into contact with the cylindrical surface of the cylindrical body to which it is to be stuck. The pressure of the securing rolls on the cylindrical body is thus of particular importance. It is important on the one hand to press the adhesive tape well and uniformly onto the substrate when using adhesive tape, in order to ensure good wetting of the substrate with the adhesive, prevent air bubbles between the adhesive tape and cylindrical surface, maximize the contact area between the adhesive tape and cylindrical surface and thus optimize the resulting adhesive action between the adhesive tape and cylindrical surface. Generally the adhesive tape reaches its final strength, when the maximum possible wetting of the adhesive against the substrate has been reached, whereby the pressure-sensitive adhesive normally needs some time, in order to run into the microscopic surface unevennesses. This process is helped by higher temperatures and a high pressure. Adhesives that achieve a high final strength and high heat resistance generally need a relatively long time to carry out this wetting process. On the other hand the pressure and duration of pressure must not be excessive, so that a foam carrier present in the adhesive tape does not collapse or lose its pressure-elastic properties. The pressure and duration of pressure must therefore be distributed uniformly over the entire contact area and be well measured.

Preferably, therefore, at least one of the securing rolls is equipped with means for recording or measuring the pressure on the cylindrical body. This can be done, for example, by recording or measuring the force acting on the roll axis in the direction away from the cylindrical axis. Preferably, in addition or alternatively, at least one of the securing rolls, preferably a repositionable securing roll, is equipped with means for adjusting or controlling the pressure on the cylindrical body. This can be done, for example, by enabling the force used to reposition the repositionable securing roll against the cylindrical body to be adjusted or controlled.

Preferably at least one of the securing rolls serves as a guide roll for the adhesive tape that is fed in. The adhesive tape is fed to the cylindrical body, to which adhesive tape is to be stuck, by first being passed around a section of the guide roll. Viewed in profile, the adhesive tape thus runs around an arc of the guide roll. Depending on the relative alignment of the direction of the feed in relation to the point of contact between the guide roll and cylindrical body, the adhesive tape can run around the arc of the guide roll in a section corresponding to a central angle from about 1° to about 270°, preferably from about 45° to about 210°, especially from about 90° to about 180°, before it is aligned with the cylindrical surface of the cylindrical body in the point of contact between the guide roll and cylindrical body and is transferred to this cylindrical surface. A large section, e.g. in the range from 120° to 170°, is an advantage first and foremost, if the contact area between the guide roll and adhesive tape is to be large, for example because the guide roll is to catch the adhesive tape.

A securing roll on which the cylindrical body lies with its own weight can serve as guide roll. This has the advantage that, in the zone where the adhesive tape comes into contact with the cylindrical surface of the cylindrical body, a pressure is exerted inherently by the cylindrical body's own weight. Alternatively, a securing roll that is disposed essentially above the axis of the cylindrical body can serve as guide roll. It is thus advantageously possible to feed the adhesive tape to the guide roll from above.

Preferably the axis of the guide roll is disposed vertically above the axis of the cylindrical body. If the adhesive tape is fed to the guide roll in a horizontal direction, it runs around a section of the guide roll, which in profile corresponds essentially to a semicircle (180°), before it is aligned with the cylindrical surface of the cylindrical body in the point of contact between the guide roll and cylindrical body and is transferred to this cylindrical surface.

The guide roll can optionally be equipped with means for catching the adhesive tape. For this the guide roll can have, on its circumference, suction openings to hold the adhesive tape temporarily by means of vacuum, whereby a suction-air control channel is connected with the suction openings. When a vacuum is applied to the suction-air control channel, this vacuum is communicated to the suction openings. If a section of the adhesive tape covers such a suction opening, this section is pressed against the surface of the guide roll because of the ambient pressure. Friction between the surfaces of the guide roll and of the adhesive tape means that the guide roll is able to transport the adhesive tape by rotating around the roll axis. In order that the action of the vacuum applied to the suction-air control channel is at its maximum, preferably the only suction openings supplied with vacuum from the suction-air control channel are those that are in the section of the guide roll over which the adhesive tape passes or that are covered by the adhesive tape.

The adhesive tape is advantageously fed to the guide roll in a horizontal direction. The adhesive tape can lie on the guide roll especially under its own weight and this can make it easier to catch or guide the adhesive tape around the guide roll. The adhesive tape is usually provided as double-sided adhesive tape, one adhesive surface of which is covered by a covering known as liner. The uncovered adhesive surface faces the cylindrical surface of the cylindrical body to which adhesive tape is to be stuck and is bonded to this surface. If a guide roll is used, the adhesive tape lies on this with its covered adhesive surface, i.e. its liner.

Optionally the adhesive tape can be provided as double-sided adhesive tape, both adhesive surfaces of which are exposed. In this case the securing rolls are advantageously provided in such a way that the adhesive tape can develop no sticking effect or only a reduced sticking effect in relation to the surface of the securing rolls. For this the surface of the securing rolls is, for example, siliconised or given a non-stick coating like, for example, polytetrafluorethylene (PTFE, Teflon). If a guide roll is used, its surface can be arranged in such a way that the adhesive tape has a certain adhesive effect, so the guide roll can "catch" and transport the adhesive tape by means of its sticking effect. Ideally, however, the adhesive effect of the adhesive tape in relation to the surface of the guide roll is weaker than in relation to the surface of the cylindrical body to which adhesive tape is to be stuck, so the adhesive tape is transferred completely to the cylindrical body at the contact area between the guide roll and cylindrical body.

Optionally, as described above, the adhesive tape can be provided on an adhesive surface with a liner, whereby the liner is removed before, during or after the application of the adhesive tape to the cylindrical body. Those securing rolls and guide rolls that are disposed in such a set-up downstream of liner removal advantageously have the reduced adhesive properties in relation to the adhesive tape that were described.

The adhesive tape is usually made available as a web of material of great length (web of adhesive tape). In this case it is necessary to shorten or cut the adhesive tape to an appropriate length before, during or after the process of applying it to the cylindrical body. For this the device can have a sectioning facility, to cut the adhesive tape off or to length, comprising at least one sectioning element. This sectioning element can be formed as a mechanical sectioning element, e.g. in the form of a cutting device. It can also be formed as a contactless sectioning element, e.g. as a water cutting device, comprising one or more water-jet nozzles, or as a laser cutting device, comprising one or more laser sources.

Preferably the sectioning element can be moved across the width of the adhesive tape web along the extent of the roll axes of the securing rolls or the cylindrical axis of the cylindrical body. For this the sectioning element can be mounted on a bearing and guide device, so it can be guided, whereby the guidance can be provided by means of a slide mounted on roller bearings or plain bearings. A movable sectioning element is normally cheaper and has a smaller footprint than a sectioning element that extends over the entire width of the adhesive tape web. Optionally, however, the sectioning element can also extend over the entire width of the adhesive tape web, especially if a contactless sectioning element is used. Thus, for example, one possibility, apart from an embodiment with one or a group of movable water-jet nozzles or laser sources, would be that the width of the adhesive tape web is covered completely by a series of nozzles or laser sources disposed next to each other that can be controlled individually or together.

If the sectioning element is implemented as a mechanical sectioning element, it exists preferably in the form of a blade, especially a crush-cut blade. In this case the sectioning process is performed by direct contact of the sectioning element with the surface of the adhesive tape web. The counter-pressure of the adhesive tape web against the blade can be provided in various ways, e.g. by way of a second, counteracting mechanical sectioning element, or by way of a cutting base or by way of suitable tensioning of the adhesive tape web. In one embodiment the guide roll can serve as cutting base. In contrast the cylindrical body preferably does not serve as cutting base.

The depth of cut can be adjustable by way of the particular cutting force. In the case of a mechanical sectioning element such as a blade the depth of cut can be varied through adjustment of the pressure force of the sectioning element against the cutting base or the tensioned adhesive tape web. If a water cutting device or a laser cutting device is used as sectioning element, the cutting force can be adjusted by controlling the parameters on the water-jet nozzles or laser sources. By adjusting the depth of cut it is possible to ensure that the sectioning element does not act or acts only moderately on the cutting base, and therefore does not damage it. This can be an advantage especially, if the guide roll serves as cutting base.

Accordingly the sectioning facility can be arranged in such a way, that the adhesive tape web of the adhesive tape is cut off in different ways. Firstly the adhesive tape together with the liner, if present, can be cut through completely. This is an advantage especially, if the adhesive tape is to be applied to the cylindrical body together with the liner, i.e. the sticky outer surface of the cylindrical body, to which adhesive tape has been applied, is to be covered. In this case it is advantageous to allow the cutting to take place between the guide roll and the cylindrical body or exactly on the guide roll, so a piece of the adhesive tape is available for the next sticking operation, if a further cylindrical body is to be covered with adhesive tape.

Secondly, it is possible for only the adhesive tape to be cut through, while the liner, if present, is left intact. This has the advantage that the adhesive tape can be conveyed through forward movement of the liner, which can make the feed of the adhesive tape to the cylindrical body, to which adhesive tape is to be stuck, easier. The liner would have to be detached from the adhesive tape in the process, before the finished cylindrical body, to which adhesive tape has been stuck, is removed from the device. Preferably the liner is wound up immediately after the adhesive tape has made contact with the cylindrical surface of the cylindrical body, to which adhesive tape is to be stuck, and adheres to this surface, e.g. immediately after the adhesive tape has been passed round the guide roller.

Alternatively the adhesive tape can be cut through completely and the liner, if present, perforated. Preferably this type of cutting takes place already before passing over the guide roll, so the perforated liner can, for example, be torn off after the guide roll. For this the guide roll can stop, while the cylindrical body, to which adhesive tape is to be stuck, continues to rotate.

This device optionally has a insertion mechanism for inserting the cylindrical body, to which adhesive tape is to be stuck, into a sticking position, i.e. a position, in which the adhesive tape can be stuck onto the cylindrical surface of the cylindrical body to which adhesive tape is to be stuck. The insertion mechanism can serve at the same time as ejection mechanism, with which the cylindrical body, to which adhesive tape has been stuck, is moved out from the sticking position to, for example, a packing or removal unit.

The sticking position is determined essentially by the relative offset of the cylindrical body in relation to the adhesive tape web. The cylindrical body is in the sticking position, when application of the adhesive tape to the cylindrical surface of the cylindrical body leads to the desired result with regard to the position of the adhesive tape on the cylindrical body. The sticking position generally exists, when the cylindrical body to which adhesive tape is to be stuck exceeds the width of the adhesive tape web in equal parts at both ends in the direction of the cylindrical axis.

Preferably the insertion and/or ejection mechanism is arranged in such a way, that it allows displacing of the cylindrical body along the extent of the roll axes of the securing rolls or the cylindrical axis of the cylindrical body. Thus it is possible to adjust or control the relative position of the cylindrical body, to which adhesive tape is to be stuck, to the position of the adhesive tape. Finding of the correct sticking position can be made easier through the use of positioning means, e.g. through one or more contact elements or photoelectric barriers along the extent of the roll axes of the securing rolls or the cylindrical axis of the cylindrical body. Such positioning means can feed back the position of the cylindrical body during the insertion and/or ejection process and, for example, bring about control of the insertion and/or ejection mechanism.

Preferably the insertion and/or ejection mechanism carries the cylindrical body, e.g. by the cylindrical body lying on the insertion and/or ejection mechanism under its own weight. The insertion and/or ejection mechanism can be arranged in such a way, that it acts on the cylindrical body such that the cylindrical body can be moved into or out of the sticking position without or with only a little additional force. Especially preferably the insertion and/or ejection mechanism brings about the displacing of the cylindrical body automatically.

In one embodiment the insertion and/or ejection mechanism can be provided by one or more conveyor belts running along the extent of the roll axes of the securing rolls or the cylindrical axis of the cylindrical body. During the insertion and/or ejection process the cylindrical body can lie under its own weight on the one or more than one conveyor belts. Preferably two or more conveyor belts are provided in parallel with a gap between them, whereby the gap between the two outermost conveyor belts is smaller than the cylinder diameter of the cylindrical body to which adhesive tape is to be stuck. The two or more conveyor belts can thus form a conveyor bed, in which the cylindrical body, to which adhesive tape is to be stuck, can lie and be held because of its own weight. The two or more conveyor belts can be inclined or be arranged to be inclinable in such a way, that their conveying surfaces point or can be aligned towards the cylindrical axis of the cylindrical body. To enable a forward movement to be brought about in the direction of the extent of the roll axes of the securing rolls or the cylindrical axis of the cylindrical body, the one or more than one conveyor belts can be equipped with the appropriate drive means.

Optionally a magazine can be provided, in which a majority of cylindrical bodies to which adhesive tape is to be stuck are kept ready. This magazine can have a dispensing unit, which is used in each case to transfer one cylindrical body, to which adhesive tape is to be stuck, to the insertion mechanism. For example the magazine can keep the cylindrical bodies, to which adhesive tape is to be stuck, stacked one on top of another axially parallel to the securing rolls, so, upon release of a cylindrical body, to which adhesive tape is to be stuck, to the dispensing unit, the cylindrical body reaches the insertion mechanism by means of gravity owing to its own weight. Further cylindrical bodies that are kept ready can be fed through likewise by means of their gravity, as the remaining stack moves up when the bottommost cylindrical body is released.

The method for applying adhesive tape to a cylindrical surface of a cylindrical body comprises essentially the steps (a) contacting the cylindrical surface of the cylindrical body with at least two axially parallel securing rolls;
(b) applying the adhesive tape to the cylindrical surface of the cylindrical body; and
(c) winding the adhesive tape onto the cylindrical body by means of the rotating of the cylindrical body about its cylindrical axis.

The process of applying the adhesive tape to the cylindrical surface of the cylindrical body begins essentially with the cylindrical body first being brought into the sticking position, i.e. the position, in which the adhesive tape can be stuck onto the cylindrical surface of the cylindrical body to which adhesive tape is to be stuck. This can be done, for example, by the cylindrical body being displaced with the help of the described insertion mechanism along the extent of the roll axes of the securing rolls or the cylindrical axis of the cylindrical body. For this the insertion mechanism can act, for example, on the cylindrical body in such a way that it is guided into the sticking position without or with only a little additional force. Especially preferably the insertion mechanism brings about the displacing of the cylindrical body automatically.

If the insertion mechanism is provided by one or more conveyor belts, the insertion process can be carried out by the one or more than one conveyor belts bringing about a forward movement in the direction of the extent of the roll axes of the securing rolls or the cylindrical axis of the cylindrical body.

The insertion process is ended, as soon as the cylindrical body has reached the sticking position. Identification of the sticking position can be made easier, if positioning means feed back the position of the cylindrical body during the insertion process and, for example, bring about or enable control of the insertion mechanism. As long as the positioning means feed back that the sticking position has not yet been reached, i.e. the cylindrical body has not been displaced sufficiently in axial direction, the insertion process is continued. If the insertion mechanism brings about the displacing of the cylindrical body automatically, the insertion mechanism continues to provide forward movement in this case. If the positioning means feed back that the sticking position has been reached, the insertion process ends and the forward movement is interrupted. If the positioning means feed back that the sticking position has been exceeded, the insertion process is reversed slowly or step by step, until the sticking position has been reached. For this the insertion mechanism can provide a movement in reverse direction.

If the cylindrical body to which adhesive tape is to be stuck is in the sticking position, the cylindrical body can be moved away from the insertion mechanism. The removal from the insertion mechanism can be brought about, for example, by the cylindrical body being now held by securing rolls, especially by the cylindrical body lying on securing rolls. For this one or more securing rolls can be moved up against the cylindrical body. Alternatively, if two or more securing rolls are already in relative positions to the cylindrical body, allowing the cylindrical body to lie there, the insertion mechanism can be moved away from the cylindrical body, so the cylindrical body is deposited on the securing rolls. A combination of the two measures is also possible. Especially, optionally, the insertion mechanism can be moved actively away from the cylindrical body to which adhesive tape is to be stuck, as soon as this body is carried or raised by the securing rolls.

Preferably one or more securing rolls are moved up against the cylindrical body, to which adhesive tape is to be stuck, from underneath the cylindrical axis of said cylindrical body, until they touch the cylindrical surface of the cylindrical body and subsequently carry or raise the cylindrical body. The repositioning or moving of the securing rolls can be achieved especially by means of a repositioning of their axle bearings, for example through the fitting of the axle bearings on a swivelling arm or through the disposition of the axle bearings on rails in such a way that said bearings are movable. The repositioning of the axle bearings can basically take place or be provided for in any direction that is suitable for bringing the securing roll(s) into contact with the cylindrical body. Preferably the repositioning of the axle bearings takes place essentially in the direction towards/away from the cylindrical axis of the cylindrical body to which adhesive tape is to be stuck. Especially preferably two or more securing rolls are mounted in such a way that they can be repositioned symmetrically in relation to a vertical through the cylindrical axis of the cylindrical body. Especially preferably is a symmetrical movement of the securing rolls diagonally upwards towards the cylindrical axis of the cylindrical body.

In one embodiment the cylindrical body is secured by three or more securing rolls. For this, three or more securing rolls make contact with the cylindrical surface of the cylindrical body from different directions in such a way that they effectively pinch the cylindrical body between themselves. For example three securing rolls in profile form a triangle around the cylindrical body in such a way that the cylindrical axis of the cylindrical body comes to lie in the triangular area. Repositioning of one or more securing rolls towards the cylindrical axis of the cylindrical body thus brings about securing of the same.

The pressure that the securing rolls produce on the cylindrical surface of the cylindrical body in this embodiment can be adjusted, such that it is possible to set the cylindrical body into rotation by rotating one of the securing rolls. At the same time the pressure can be adjusted, so the subsequently applied adhesive tape is pressed onto the cylindrical surface of the cylindrical body in a suitable way. For this the pressure can be recorded or measured and, through control of the movement of one or more securing rolls towards/away from the cylindrical axis of the cylindrical body, controlled.

When the cylindrical body is held or secured by the securing rolls, the sticking step can begin. For this an adhesive surface of the adhesive tape is first brought into contact with the cylindrical surface of the cylindrical body. Then the cylindrical body is set into rotation about its cylindrical axis, so the adhesive tape is wound on the cylindrical surface. The cylindrical body can be rotated through the rotation of one or more securing rolls.

During the winding of the adhesive tape onto the cylindrical body the adhesive tape passes one or more securing rolls. The pressure that the securing rolls produce on the cylindrical surface of the cylindrical body presses the adhesive tape onto the cylindrical surface in a suitable way.

Preferably the adhesive tape is fed to the cylindrical body by way of at least one guide roll, which is formed by at least one of the securing rolls. That means that the adhesive tape is passed around a section of the relevant securing roll(s), before it comes into contact with the cylindrical surface of the cylindrical body. Viewed in profile, the adhesive tape runs around an arc of the guide roll. Depending on the relative alignment of the direction of the feed in relation to the point of contact between the guide roll and cylindrical body, the adhesive tape can run around the arc of the guide roll in a section corresponding to a central angle from about 1° to about 270°, preferably from about 45° to about 210°, especially from about 90° to about 180°, before it is aligned with the cylindrical surface of the cylindrical body in the point of contact between the guide roll and cylindrical body and is transferred to this cylindrical surface. A large section, e.g. in the range from 120° bis 170°, is an advantage in particular if the contact area between the guide roll and adhesive tape is to be large, e.g. because the guide roll is to catch the adhesive tape. This can be achieved, for example, by means of a vacuum.

The winding of the adhesive tape onto the cylindrical body is ideally interrupted before a second layer of adhesive tape comes into being on the cylindrical surface. For this the rotation of the cylindrical body is stopped, before it has performed a complete rotation since contact with the adhesive tape.

Now the adhesive tape can be cut off. Preferably the adhesive tape should be cut off such that the start and end of the strip of adhesive tape applied to the cylindrical body lie adjacent to each other with minimum gap. Therefore preferably there should be no resulting gap between the abutting ends of the strip of adhesive tape and the abutting ends of the strip of adhesive tape should also not overlap. The length of the strip of adhesive tape therefore ideally corresponds to the circumference of the cylindrical body.

In order for the adhesive tape to be cut exactly to length, a sectioning or perforating process can take place parallel to the cylindrical axis of the cylindrical body. This can be done by means of a mechanical sectioning element like, for example, a cutting device, or alternatively by means of a contactless sectioning element like, for example, a water cutting device or a laser cutting device. The sectioning or perforating process is performed preferably by moving the sectioning element along the extent of the roll axes of the securing rolls or the cylindrical axis of the cylindrical body.

If the sectioning element is implemented as a mechanical sectioning element, the sectioning process can be performed by direct contact of the sectioning element with the surface of the adhesive tape web. The counter-pressure of the adhesive tape web against the blade can be provided in various ways, e.g. by way of a second, counteracting mechanical sectioning element or by way of a cutting base or by way of suitable tensioning of the adhesive tape web. In one embodiment the guide roll can serve as cutting base. In contrast the cylindrical body preferably does not serve as cutting base.

The depth of cut can be varied by way of the particular cutting force, e.g. by adjusting the pressure force of the sectioning element against the cutting base or the tensioned adhesive tape web. If a water cutting device or a laser cutting device is used as sectioning element, the cutting force can be adjusted by controlling the parameters on the water-jet nozzles or laser sources. By adjusting the depth of cut it is possible to ensure that the sectioning element does not act or acts only moderately on the cutting base, and therefore does not damage it. This can be an advantage especially, if the guide roll serves as cutting base.

Accordingly the adhesive tape web of the adhesive tape can be cut off in different ways. Firstly the adhesive tape together with the liner, if present, can be cut through completely. This is an advantage especially, if the adhesive tape is to be applied to the cylindrical body together with the liner, i.e. the sticky outer surface of the cylindrical body, to which adhesive tape has been applied, is to be covered. In this case it is advantageous to allow the cutting to take place between the guide roll and the cylindrical body or exactly on the guide roll, so a piece of the adhesive tape is available for the next sticking operation, if a further cylindrical body is to be covered with adhesive tape.

Secondly, it is possible for only the adhesive tape to be cut through, while the liner, if present, is left intact. This has the advantage that the adhesive tape can be conveyed through forward movement of the liner, which can make the feed of the adhesive tape to the cylindrical body to which adhesive tape is to be stuck easier. The liner would have to be detached from the adhesive tape in the process, before the finished cylindrical body, to which adhesive tape has been stuck, is removed from the device. Preferably the liner is wound up immediately after the adhesive tape has made contact with the cylindrical surface of the cylindrical body, to which adhesive tape is to be stuck, and adheres to this surface, e.g. immediately after the adhesive tape has passed round the guide roller.

Alternatively the adhesive tape can be cut through completely and the liner, if present, perforated. Preferably this type of cutting takes place already before passing over the guide roll, so the perforated liner can, for example, be torn off after the guide roll. For this the guide roll can stop, while the cylindrical body, to which adhesive tape is to be stuck, continues to rotate.

After the adhesive tape has been cut to length, the cylindrical body is preferably rotated further, so the remainder of the cut strip of adhesive tape also comes into contact with the cylindrical surface of the cylindrical body and passes at least one of the pressure points, i.e. the contact points between the securing rolls and cylindrical surface.

Lastly the cylindrical body, to which adhesive tape has been stuck, is released again from the securing rolls, preferably through the carrying-out of the holding or securing steps in reverse order. In the process the cylindrical body, to which adhesive tape has been stuck, can finally be handed back to the insertion mechanism, which can now serve as ejection mechanism, by supporting or bringing about a movement of the cylindrical body, to which adhesive tape has been stuck, from the sticking position. If the insertion mechanism was provided by means of one or more conveyor belts, the ejection process can be performed by the one or more than one conveyor belts bringing about a forward movement in the direction of the extent of the roll axes of the securing rolls or the cylindrical axis of the cylindrical body, which conveys the cylindrical body, to which adhesive tape has been stuck, out of the device. Preferably the direction of ejection is the same as the direction of insertion.

The invention is described below on the basis of preferred exemplary embodiments in conjunction with the attached drawings.

Figure 1A:
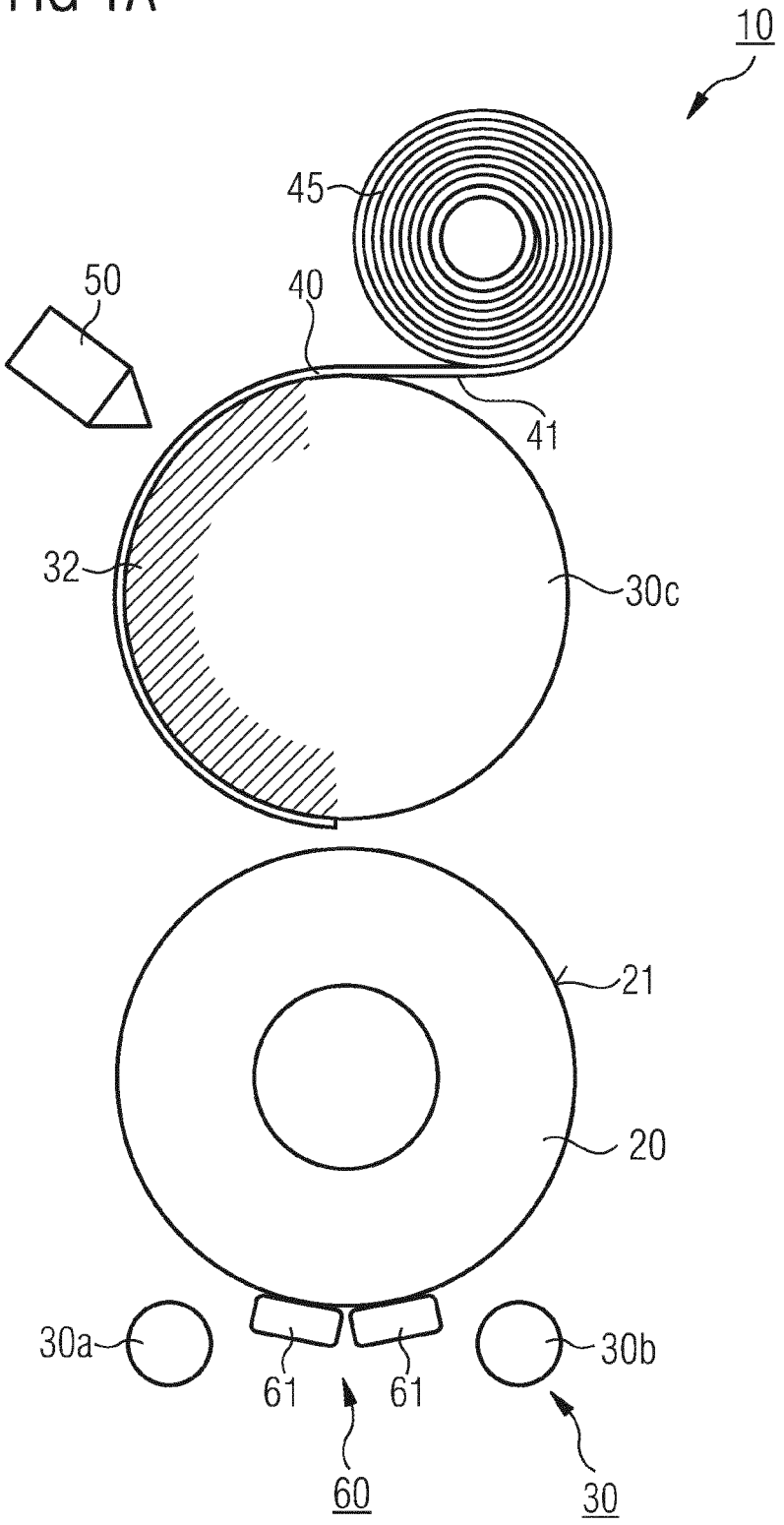
FIGS. 1A to 1F are schematic sectional views of an embodiment of the invention, which illustrate the device and method for applying adhesive tape to a cylindrical surface of a cylindrical body.

FIG. 1A shows a schematic sectional view of a device 10 for applying adhesive tape 40 to a cylindrical surface 21 of a cylindrical body 20. The device 10 comprises securing rolls 30, one of which is embodied in the form of a guide roll 30*c*. The guide roll 30*c* has a vacuum zone 32, in which the adhesive tape 40 is held on guide roll 30*c* by means of a vacuum. The adhesive tape 40 is provided as adhesive tape web from a roll of adhesive tape 45. In the shown embodiment this is a double-sided adhesive tape, one adhesive surface of which is covered by a covering or a liner 41. In the process the adhesive tape 40 is unwound from the roll of adhesive tape 45 in such a way that the liner 41 is in a position between the adhesive tape 40 and the lateral surface of the guide roll 30*c*. A sectioning facility 50 is provided, to cut the adhesive tape into individual strips of adhesive tape.

In FIG. 1A the cylindrical body 20 lies on conveyor belts 61 of a insertion mechanism 60. With the help of the conveyor belts 61 or of the insertion mechanism 60 the cylindrical body 20 can be displaced along its cylindrical axis, until it is in a sticking position within the shown device 10, i.e. a position, in which the adhesive tape 40 can be stuck onto the cylindrical surface 21 of the cylindrical body 20. Therefore in a first step of an embodiment of the method for applying the adhesive tape 40 to the cylindrical surface 21 of the cylindrical body 20 the cylindrical body 20 is first placed outside the drawing plane of FIG. 1A onto the conveyor belts 61 of the insertion mechanism 60 and transported into the drawing plane of FIG. 1A with the help of the conveyor belts 61. When the sticking position is reached, the forward movement of the conveyor belts 61 stops and the phase in which the cylindrical body 20 is secured by means of the securing rolls 30 begins. For this purpose the bottom two securing rolls 30*a*, 30*b* are moved orthogonally to the extent of their roll axes and symmetrically to each other towards the cylindrical axis of the cylindrical body 20.

Figure 1B:
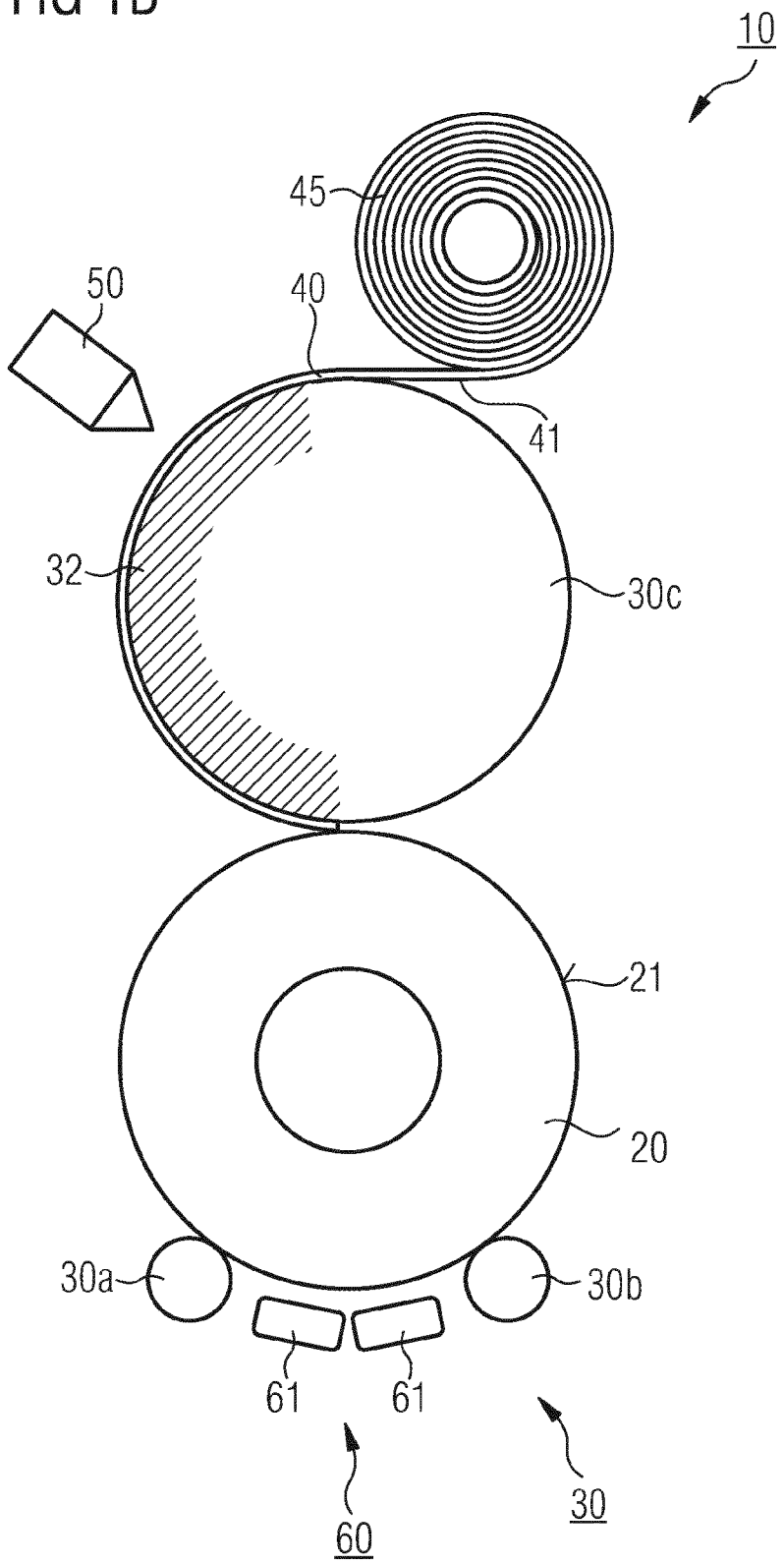

After a certain time the securing rolls 30*a*, 30*b* make contact with the cylindrical surface 21 of the cylindrical body 20 with their respective lateral surfaces and begin to raise this cylindrical body from the conveyor belts 61 of the insertion mechanism 60, as shown in FIG. 1B. The securing rolls 30*a*, 30*b* are moved towards the cylindrical axis of the cylindrical body 20 until the cylindrical body 20 is raised completely from the conveyor belts 61 of the insertion mechanism 60 and makes contact with the lateral surface of guide roll 30*c*. Means to record the pressure (not shown)

ensure that the movement of the securing rolls 30*a*, 30*b* is interrupted, as soon as the desired pressure of one or more securing rolls 30*a*, 30*b* on the cylindrical surface 21 of the cylindrical body 20 has reached a desired value.

Figure 1C:
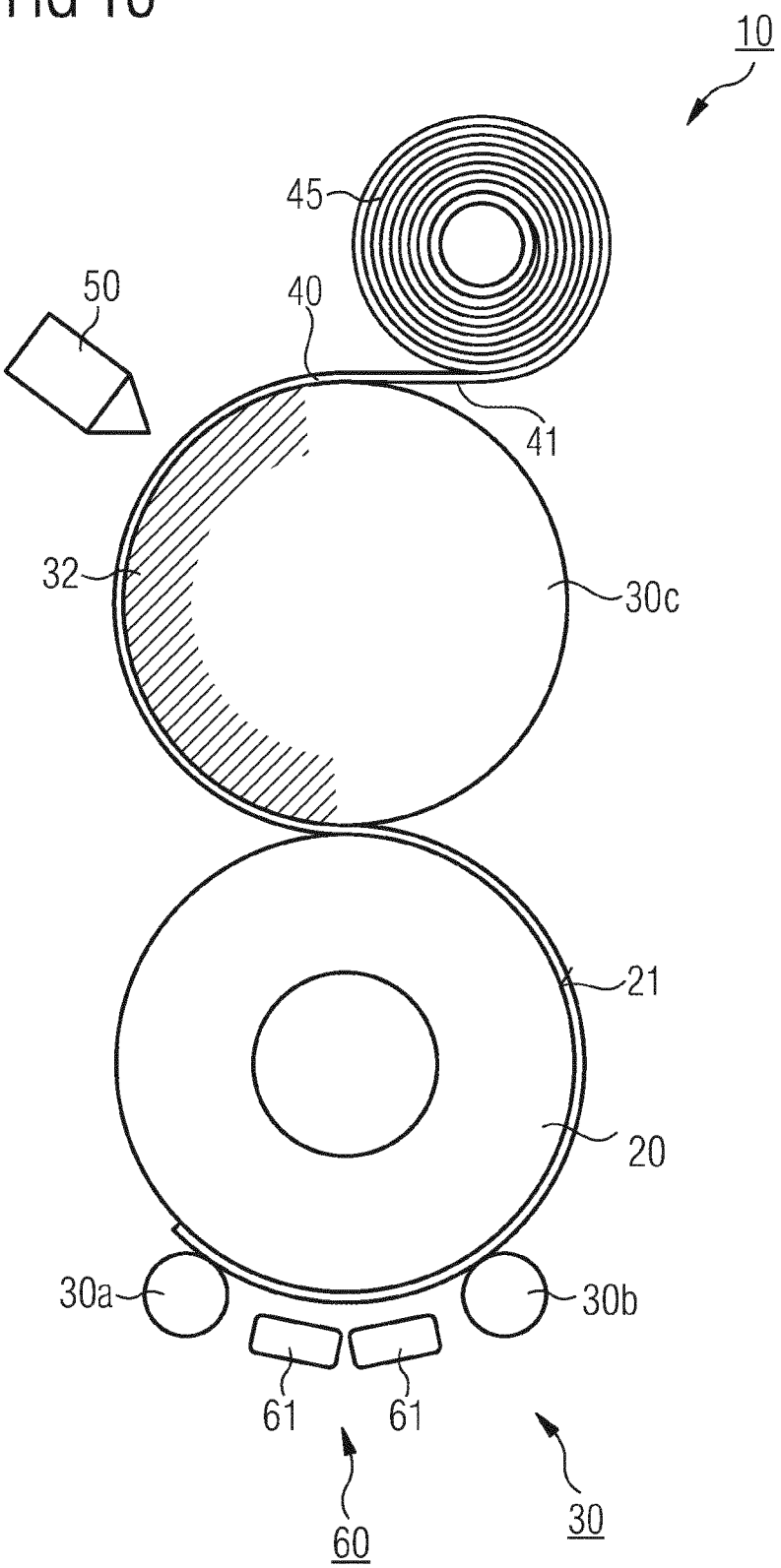

In the next step, illustrated in FIG. 1C, the adhesive tape 40 is applied to the cylindrical surface 21 of the cylindrical body 20. For this, in the embodiment that is shown, one of the securing rolls 30*a*, 30*b* is set into anticlockwise rotation around its roll axis by means of a drive (not shown). The friction that exists between the lateral surface of the driven securing roll 30*a*/30*b* and the cylindrical surface 21 of the cylindrical body 20 leads to clockwise rotation of the cylindrical body 20 around its cylindrical axis. The rotation of the cylindrical body 20 is transferred in turn to the guide roll 30*c*, which rotates accordingly anticlockwise and unwinds the adhesive tape 40 from the roll of adhesive tape 45 and feeds it to the cylindrical surface 21 of the cylindrical body 20.

As mentioned already, the side of the adhesive tape 40 facing away from the lateral surface of the guide roll 30*c* is exposed and sticky. Therefore as soon as the adhesive tape 40 is fed to the cylindrical surface 21 of the cylindrical body 20 owing to the rotation of the guide roll 30*c*, it begins to stick to the cylindrical surface 21 of the cylindrical body 20. Continued rotation of the cylindrical body 20 and of the guide roll 30*c* leads to the adhesive tape 40 being wound gradually onto the cylindrical surface 21 of the cylindrical body 20. The desired adhesion of the adhesive tape 40 to the cylindrical surface 21 of the cylindrical body 20 is provided by the pressure that the guide roll 30*c* exerts with its lateral surface on the cylindrical surface 21 of the cylindrical body 20.

Figure 1D:
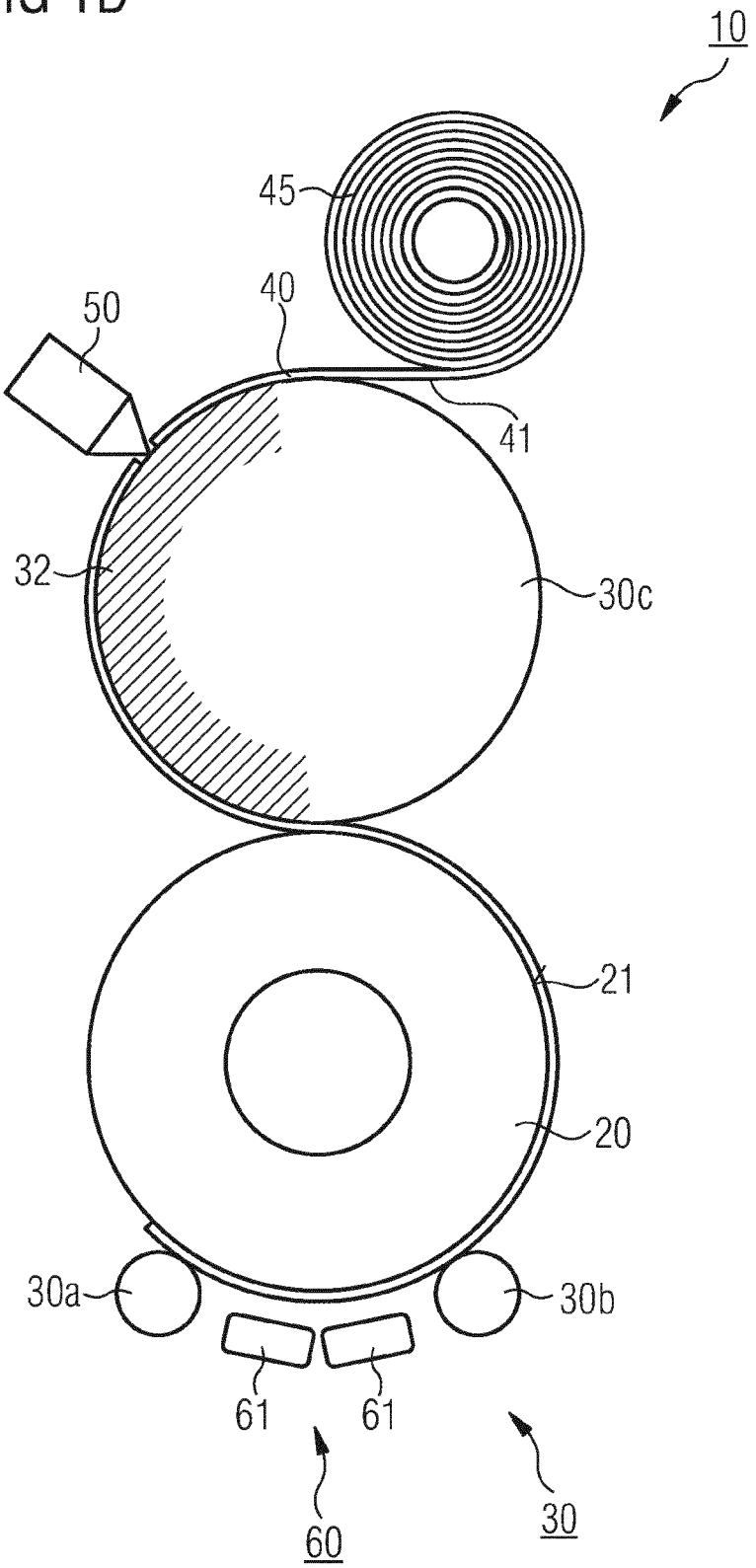

Before the cylindrical body 20 has performed a complete rotation about its cylindrical axis, the drive of the securing roll 30*a*/30*b* is interrupted and the adhesive tape 40, together with liner 41, is cut through by means of the sectioning facility 50, as illustrated in FIG. 1D. This process takes place, when the length of the adhesive tape 40 already wound on the cylindrical body 20 together with the length of the not yet wound adhesive tape 40 that is between the cylindrical body 20 and the sectioning facility 50 equals the cylindrical circumference of the cylindrical body 20. As a result of this the length of the cut-off strip of adhesive tape is equal to the cylindrical circumference of the cylindrical body 20 and can consequently cover this in exactly one layer.

Figure 1E:
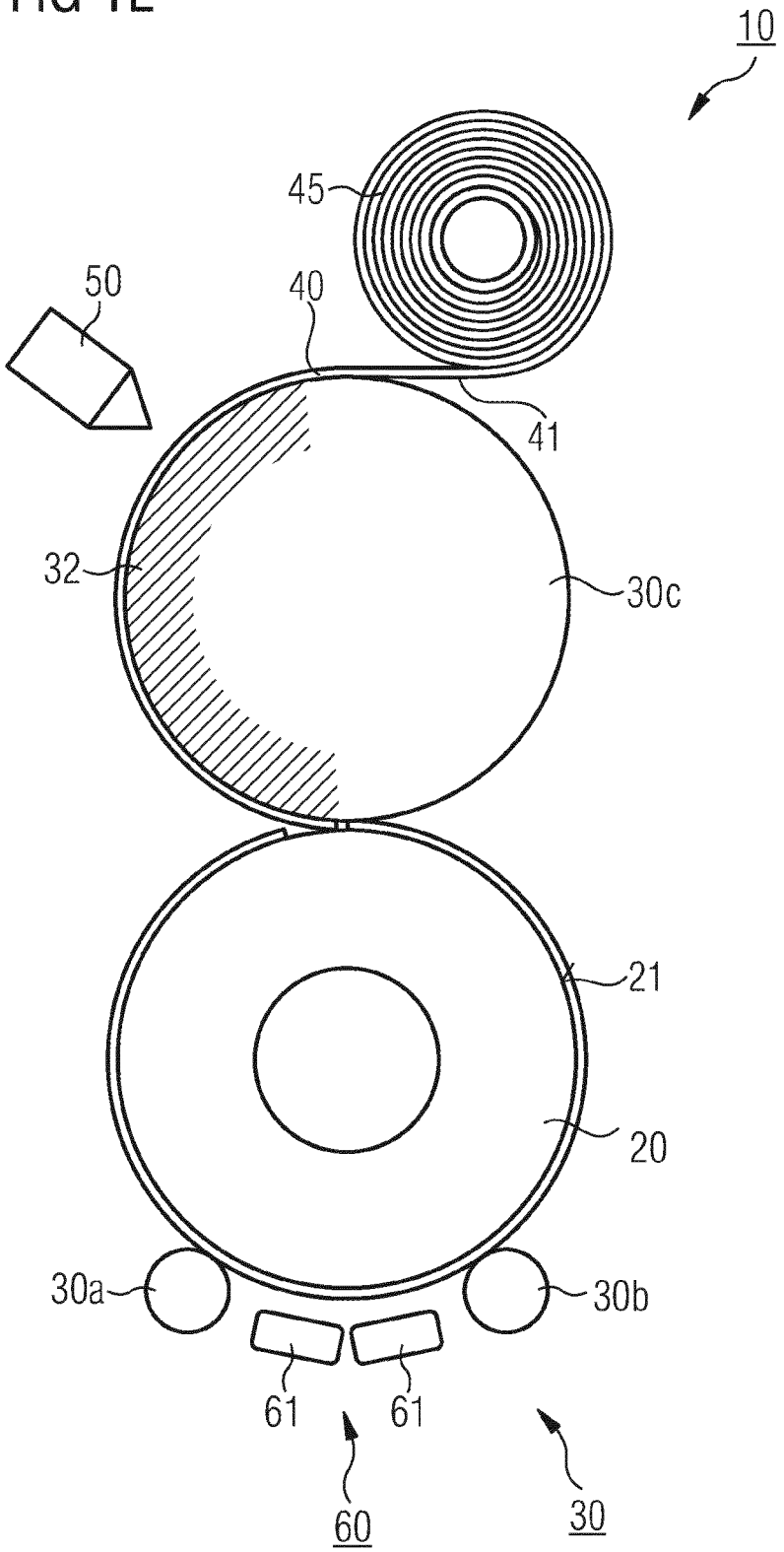

After the adhesive tape 40 has been cut to length by the sectioning facility 50, the drive of the securing roll 30*a*/30*b* is reactivated, so the cylindrical body 20 continues to rotate and the remaining section of the strip of adhesive tape is stuck onto the cylindrical surface 21 of the cylindrical body 20, as shown in FIG. 1E. When this process has been completed, the stuck-on strip of adhesive tape surrounds the cylindrical surface 21 of the cylindrical body 20 in one layer—without any overlapping and ideally without any significant gap between the abutting edges of the strip of adhesive tape.

Any adhesion of the subsequent adhesive tape 40 that is fed to the already covered cylindrical surface 21 of the cylindrical body 20 by means of the guide roll 30*c* is prevented by the adhesive strip on the cylindrical surface 21 of the cylindrical body 20 still carrying the already mentioned liner 41 on its outward-facing surface.

Figure 1F:
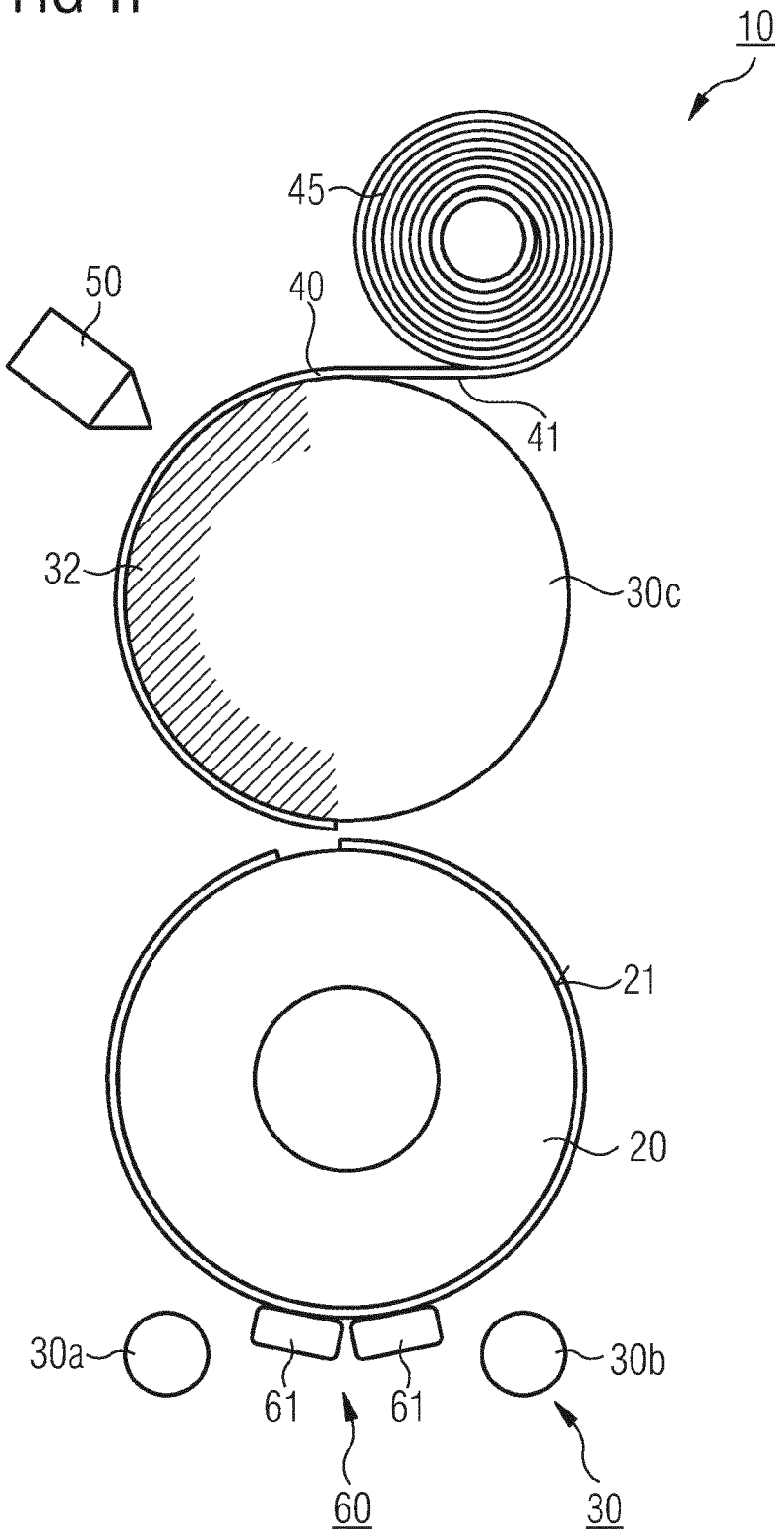

After the entire cylindrical surface 21 of the cylindrical body 20 has been covered with adhesive tape, the drive of the securing roll 30*a*/30*b* is again interrupted and the cylindrical body 20 is again deposited on the conveyor belts 61 of the insertion mechanism 60, as shown in FIG. 1F. For this the securing rolls 30*a*, 30*b* again move, orthogonally to their roll axes and symmetrically to each other, diagonally downwards into their initial position. The cylindrical body 20, to which adhesive tape has been stuck, is finally moved out of the sticking position by means of the conveyor belts 61, which now serve as ejection mechanism. In the embodiment shown this is done by further transportation of the cylindrical body 21, to which adhesive tape has been stuck, into the drawing plane, where it is handed over to a packing and removal unit (not shown).

Figure 2:
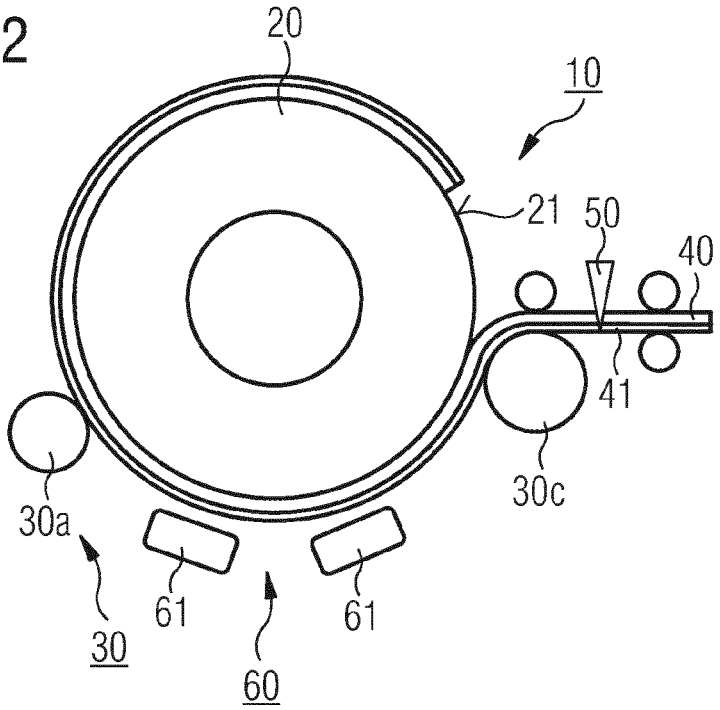
FIG. 2 is a schematic sectional view of a further embodiment of the invention, in which the cylindrical body lies on the guide roll under its own weight.

FIG. 2 shows a further embodiment of the device 10, comprising a cylindrical body 20, securing rolls 30, one of which serves as guide roll 30*c*, adhesive tape 40 and a sectioning facility 50. The adhesive tape 40 is again provided as double-sided adhesive tape, one surface of which—the downward-facing surface in the example shown—is covered with a liner 41.

In the embodiment shown the cylindrical body 20 lies on the guide roll 30*c* under its own weight. This has the advantage that the maximum pressure is provided on the contact area between the lateral surface of the guide roll 30*c* and the cylindrical surface 21 of the cylindrical body 20. In addition, in this embodiment, if the own weight of the cylindrical body 20 allows it, the provision of only two securing rolls 30, one of which forms the guide roll 30*c*, might suffice.

In this embodiment the cylindrical body 20 is again fed to the sticking position by means of conveyor belts 61 of a insertion mechanism 60. Then the insertion mechanism 60 is moved downwards from the cylindrical body 20, so the cylindrical body 20 is deposited on the securing roll 30*a* and the guide roll 30*c*. A drive of the securing roll 30*a* around its roll axis sets the cylindrical body 20 into rotation about its cylindrical axis, which in turn sets the guide roll 30*c* into rotation and brings about the feeding of the adhesive tape 40 to the cylindrical surface 21 of the cylindrical body 20. As a result of further rotation the adhesive tape 40 is wound onto the cylindrical surface 21 of the cylindrical body 20 and is stuck onto the cylindrical surface 21 of the cylindrical body 20 as a result of the pressure that exists between the lateral surface of the guide roll 30*c* and the cylindrical surface 21 of the cylindrical body 20. Before the cylindrical body 20 has performed a complete rotation about its cylindrical axis, the drive of the securing roll 30*a* is interrupted and the sectioning facility 50 cuts through the adhesive tape 40 and the liner 41. The drive of the securing roll 30*a* is then restarted and the cylindrical body 20 is rotated further about its cylindrical axis, until the cylindrical surface 21, as described already, is covered completely by a single layer of the adhesive tape. Lastly the insertion mechanism 60 is again moved from below onto the cylindrical body 20, until the cylindrical body 20 lies on the conveyor belts 61 of the insertion mechanism 60 and is raised from the securing roll 30*a* and the guide roll 30*c*, and the cylindrical body 20, to which adhesive tape has been stuck, is conveyed out of the sticking position by means of the conveyor belts 61.

Figure 3:
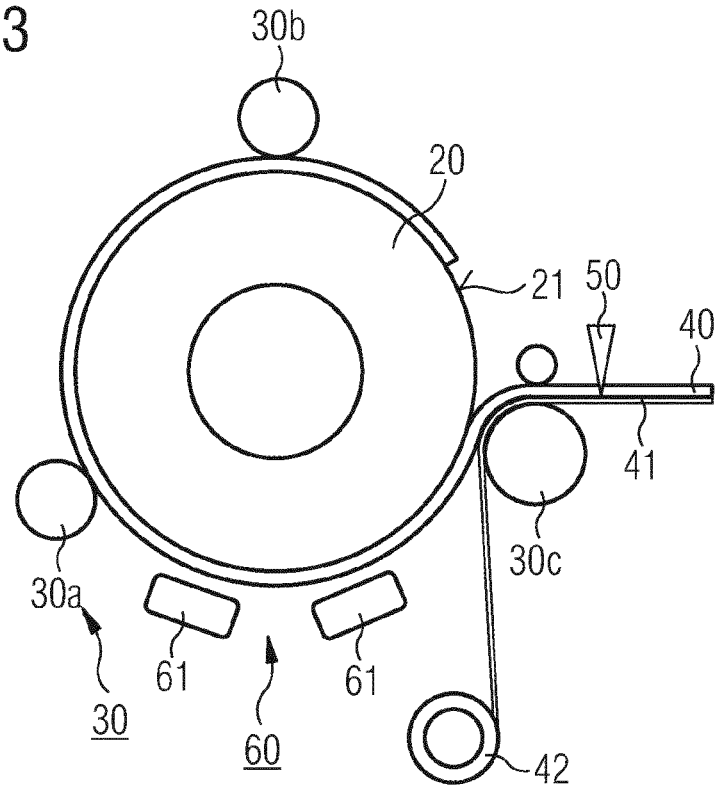
FIG. 3 is a schematic sectional view of a further embodiment of the invention, in which the liner of the adhesive tape is detached from the adhesive tape and wound up, after the adhesive tape has been passed round the guide roller.

The embodiment shown in FIG. 3 differs from the embodiment shown in FIG. 2 essentially in that the liner 41 on the double-sided adhesive tape is removed from the adhesive tape 40 during the winding of the adhesive tape 40 onto the cylindrical surface 21 of the cylindrical body 20 and is wound on a liner winder 42. Consequently in this embodiment the outer surface of the cylindrical body 20 to which adhesive tape has been stuck is sticky, so the securing rolls 30 and also the conveyor belts 61 of the insertion mechanism 60 are designed to be adhesive-repellent (e.g. siliconised).

The feed of the cylindrical body 20 into the sticking position is carried out in the manner described by means of the conveyor belts 61 of the insertion mechanism 60. In this embodiment, as soon as the sticking position has been reached, the cylindrical body 20 is raised from the conveyor belts 61 of the insertion mechanism 60 by the left lower securing roll 30*a* being moved up against the cylindrical body 20. In this embodiment the adhesive tape 40 can also be fed by driving of the liner winder 42, while the winding of the adhesive tape onto the cylindrical surface 21 of the cylindrical body 20 takes place in turn as a result of the driving of one of the securing rolls 30*a*, 30*b*. A sectioning facility 50 is again used to cut the adhesive tape 40 to length, though in this embodiment only the adhesive tape 40, not the liner 41, is cut through.

The cylindrical body 20 to which adhesive tape has been stuck is removed lastly in the manner already described, whereby in this embodiment the cylindrical body 20 to which adhesive tape has been stuck leaves the device with a sticky surface, allowing immediate further processing of the same.

The device and the method have been described with examples of embodiments that serve to clarify the invention, though they should not restrict the scope of protection defined by the claims. If applicable, any of the individual features presented in the individual exemplary embodiments can be combined with each other and/or replaced, without leaving the scope of the invention.

LIST OF REFERENCE SIGNS

10 device for applying adhesive tape
20 cylindrical body
21 cylindrical surface
30 securing rolls
30*a*, 30*b* movable/driven securing rolls
30*c* guide roll
32 vacuum zone
40 adhesive tape
41 liner
42 liner winder
45 roll of adhesive tape
50 sectioning facility
60 insertion mechanism
61 conveyor belts

The invention claimed is:

1. A method for applying adhesive tape to a cylindrical surface of a cylindrical body, comprising:

(a) positioning the cylindrical body on at least one conveyor belt;

(b) contacting the cylindrical surface of the cylindrical body with respective lateral surfaces of at least two axially parallel securing rolls;

(c) moving the cylindrical body away from the at least one conveyor belt by displacing the at least two securing rolls relative to the at least one conveyer belt and/or displacing the at least one conveyer belt relative to the at least two securing rolls;

(d) applying the adhesive tape to the cylindrical surface of the cylindrical body; and (e) winding the adhesive tape onto the cylindrical body by rotating the cylindrical body about a cylindrical axis of the cylindrical body.

2. The method according to claim 1, wherein at least one of the securing rolls serves as guide roll for the adhesive tape, wherein the adhesive tape is passed around the guide roll in a section corresponding to a central angle from about 1° to about 270°.

3. The method according to claim 2, wherein the guide roll catches the adhesive tape by suction.

4. The method according to claim 2, wherein the adhesive tape is passed around the guide roll in a section corresponding to a central angle from about 45° to about 210°.

5. The method according to claim 2, wherein the adhesive tape is passed around the guide roll in a section corresponding to a central angle from about 90° to about 180°.

6. The method according to claim 1, wherein, in step (c), the at least one conveyor belt is movable away from the cylindrical body.

7. The method according to claim 1, further comprising at least partially cutting-through the adhesive tape with a cutting blade, a water cutting device, or a laser cutting device.

8. The method according to claim 1, further comprising—before the contacting step and/or after the winding step—displacing the cylindrical body along roll axes of the securing rolls or along the cylindrical axis of the cylindrical body via the at least one conveyor belt.

9. The method according to claim 1, further comprising positioning the cylindrical body relative to an adhesive tape feed.

10. The method according to claim 9, wherein the cylindrical body is positioned relative to the adhesive tape feed by contact elements.

11. The method according to claim 1, wherein contact with the cylindrical surface of the cylindrical body is made by at least three axially parallel securing rolls, which are disposed around a cylindrical circumference of the cylindrical body in such a way that the at least three securing rolls pinch the cylindrical body therebetween.

* * * * *